US005120399A

United States Patent [19]

Filzen

[11] Patent Number: 5,120,399

[45] Date of Patent: Jun. 9, 1992

[54] PRESS SECTION WITH INVERTED EXTENDED NIP PRESS AND ROLL PRESS

[75] Inventor: Scott E. Filzen, Eau Claire, Wis.

[73] Assignee: Beloit Corporation, Beloit, Wis.

[21] Appl. No.: 705,484

[22] Filed: May 24, 1991

[51] Int. Cl.[5] ..... D21F 3/04

[52] U.S. Cl. ..... 162/205; 162/359; 162/360.1

[58] Field of Search ..... 162/358, 359, 360.1, 162/205

[56] References Cited

U.S. PATENT DOCUMENTS 4,483,745 11/1984 Wicks et al. ..... 162/360.1
4,874,470 10/1989 Skaugen ..... 162/360.1
4,880,502 11/1989 Wedel ..... 162/358
4,915,790 4/1990 Dahl ..... 162/360.1
4,919,761 4/1990 Schiel et al. ..... 162/358
4,976,820 11/1990 Laapotti ..... 162/358

*Primary Examiner*—Karen M. Hastings
*Attorney, Agent, or Firm*—Dirk J. Veneman; Raymond W. Campbell; David J. Archer

[57] ABSTRACT

A press apparatus is disclosed for pressing a formed web of paper. The apparatus includes an extended nip press for pressing water from the formed web. A press roll is disposed downstream relative to the extended nip press, and a roll cooperates with the press roll for defining therebetween a roll couple for further pressing the web such that substantially uniform surface characteristics are imparted to both sides of the web.

8 Claims, 1 Drawing Sheet

PRESS SECTION WITH INVERTED EXTENDED NIP PRESS AND ROLL PRESS

BACKGROUND OF THE INVENTION

1. Field of the Invention

The present invention relates to a press apparatus for pressing a formed web. More particularly, the present invention relates to a press apparatus which includes an extended nip press.

2. Information Disclosure Statement

In the prior art, TRI-NIP or Tri-Vent presses followed by a fourth smoothing press have resulted in newsprint and fine paper having improved sheet symmetry. Such symmetry is achieved primarily by pressing one surface of the web directly against a press roll and then subsequently smoothing the opposite side of the web during movement of the web through the smoothing press, which is the fourth press in the aforementioned TRI-NIP configuration. TRI-NIP is a registered trademark of Beloit Corporation, and Tri-Vent is a common law mark of Beloit Corporation The dryness of the web produced on the aforementioned machines is within the range 30 to 43 percent solids at 4,000 feet per minute.

Although an extended nip press is generally more expensive than a press including conventional roll couples, such is not necessarily the case when the cost of several spare rolls and ancillary equipment for the aforementioned TRI-NIP press is factored into costs. The cost of an extended nip press is, therefor, comparable and has the advantage that a sheet between 48 to 52 percent solids can be produced at 4,000 feet per minute.

More specifically, the TRI-NIP press or Tri-Vent press plus fourth press are relatively costly and are particularly labor intensive with regard to felt changes.

The present invention provides the following advantages. First, the number of press nips and press framework is reduced. Secondly, the clothing requirements, that is the number of press felts required, is reduced, thereby reducing the amount of time that the press is idle during felt changes.

Additionally, the dryness of the web out of the press is increased according to the configuration of the press apparatus according to the present invention.

The aforementioned objectives are attained in the present invention by providing an inverted single felted extended nip press in the first press position. Such ENP cooperates with a transfer felt so that the web will be riding on a bottom felt as it passes through a single felted roll press in the second press position. The second press only increases the dryness of the web by 2 to 3 percent but achieves the goal of generating a web that is less two-sided.

Therefore, it is a primary objective of the present invention to provide a press apparatus which increases the dryness of the resultant web while enhancing the resultant sheet symmetry.

Other objects and advantages of the present invention will be readily apparent to those skilled in the art by a consideration of the detailed description contained hereinafter taken in conjunction with the annexed drawings.

SUMMARY OF THE INVENTION

The present invention relates to a press apparatus for pressing a formed web of paper. The apparatus includes an extended nip press for pressing water from the formed web. A press roll is disposed downstream relative to the extended nip press, and a roll cooperates with the press roll for defining therebetween a roll couple for further pressing the web such that substantially uniform surface characteristics are imparted to both sides of the web.

In a more specific embodiment of the present invention, the extended nip press includes a backing roll which defines a smooth peripheral surface such that the web extends around the backing roll so that one side of the web is in direct contact with the smooth surface.

An elongate pressing member cooperates with the smooth surface for defining therebetween an extended pressing section for the passage therethrough of the web.

Additionally, a bearing blanket slidably cooperates with the press member such that the web is disposed between the blanket and the backing roll during movement of the blanket and web through the pressing section.

In a preferred embodiment of the present invention, the backing roll is disposed beneath the elongate pressing member such that removal of broke is facilitated.

In one embodiment of the present invention, the elongate pressing member is an elongate shoe which defines a concave surface which cooperates with the smooth peripheral surface of the backing roll for defining therebetween the pressing section.

In an alternative embodiment of the present invention, the elongate pressing member is a hydrostatic shoe.

The press roll defines a further smooth peripheral surface such that the further smooth surface comes into direct contact with the opposite side of the web relative to the one side contacting the smooth surface so that substantially uniform surface characteristics are imparted to both sides of the web.

Additionally, the press apparatus includes a pick-up roll which is disposed closely adjacent to the formed web for picking up the web.

A press felt extends around the pick-up roll such that the press felt is disposed between the web and the pick-up roll so that the web is picked up onto the press felt.

A steam box is disposed closely adjacent to the press felt and downstream relative to the pick-up roll. The steam box is connected to a source of pressurized steam such that the steam is applied directly to the web supported by the press felt.

Vacuum means are disposed closely adjacent to the steam box such that the press felt and the web are disposed between the steam box and the vacuum means. The press felt is disposed between the web and the vacuum means, and the vacuum means draws steam through the web and the press felt. The arrangement is such that the extended nip press is disposed downstream relative to the vacuum means.

More particularly, the bearing blanket slidably cooperates with the pressing member such that the press felt and the web are disposed between the bearing blanket and the backing roll during contiguous movement of the bearing blanket, the press felt and the web through the pressing section.

The press apparatus also includes a suction roll which is disposed downstream relative to the pressing section such that the web is guided from the pressing section in an open draw to and around the suction roll.

A further felt extends around the suction roll such that the further felt is disposed between the web and the suction roll.

A further steam box cooperates with the suction roll, the further steam box being connected to the source of pressurized steam such that pressurized steam is applied directly to the pressed web. Excess steam is drawn through the further felt and through the suction roll.

A transfer felt is disposed downstream relative to the suction roll for transferring the web from the further felt to the transfer felt.

A suction guide roll is disposed closely adjacent to the further felt. The transfer felt extends around the suction guide roll such that the web is disposed between the further felt and the transfer felt. The arrangement is such that when the suction guide roll is connected to a source of partial vacuum, the web transfers from the further felt to the transfer felt.

The press roll is disposed downstream relative to the suction guide roll, and the roll cooperating with the press roll is a vented roll.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
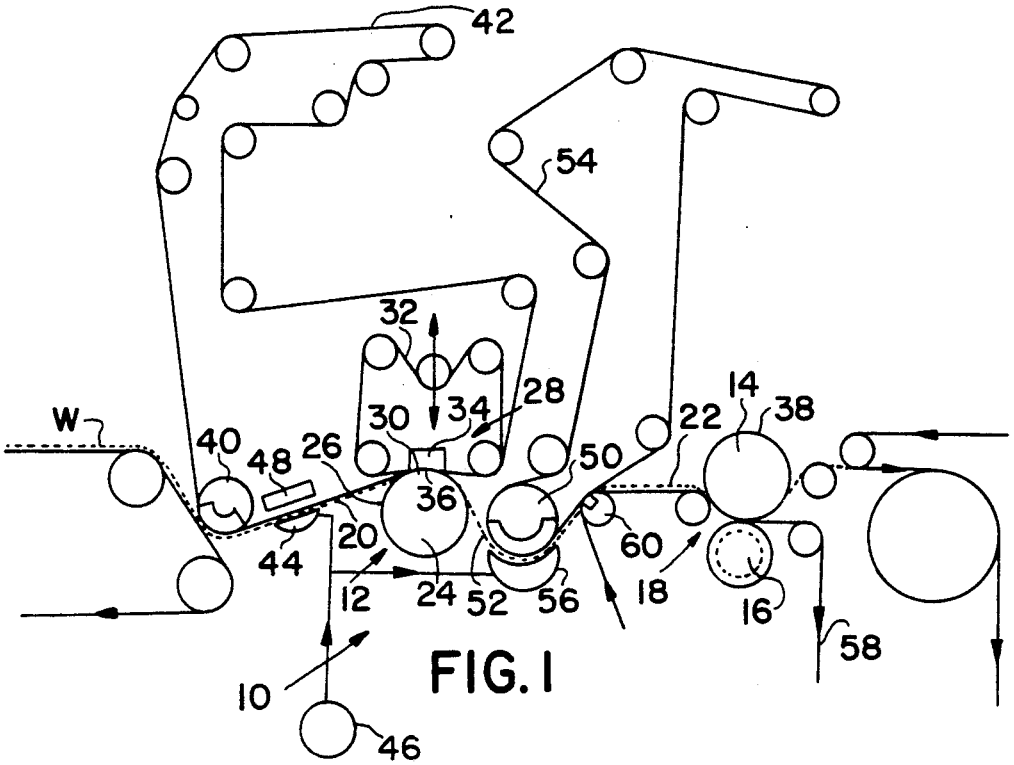
FIG. 1 is a side-elevational view of one embodiment of the present invention showing an elongate hydrodynamic shoe of an extended nip press.

FIG. 1 is a side-elevational view of a press apparatus generally designated 1 according to the present invention for pressing a formed web of paper W shown as a dashed line. The apparatus 10 includes an extended nip press, generally designated 12, for pressing water from the formed web W. A press roll 14 is disposed downstream relative to the extended nip press 12 and a roll 16 cooperates with the press roll 14 for defining therebetween a roll couple, generally designated 18, for further pressing the web W such that substantially uniform surface characteristics are imparted to both sides 20 and 22 of the web W.

As shown in FIG. 1, the extended nip press 12 includes a backing roll 24 defining a smooth peripheral surface 26 such that the web W extends around the backing roll 24 so that one side 20 of the web W is in direct contact with the smooth surface 26.

An elongate pressing member generally designated 28 cooperates with the smooth surface 2 for defining therebetween an extended pressing section 30 for the passage therethrough of the web W.

A bearing blanket 32 slidably cooperates with the press member 28 such that the web W is disposed between the blanket 32 and the backing roll 24 during movement of the blanket 32 and web W through the pressing section 30.

As shown in FIG. 1, the backing roll 24 is disposed beneath the elongate pressing member 28 such that removal of broke is facilitated.

The elongate pressing member 28 is an elongate shoe which defines a concave surface 36 which cooperates with the smooth peripheral surface 26 for defining therebetween the pressing section 30.

Figure 2:
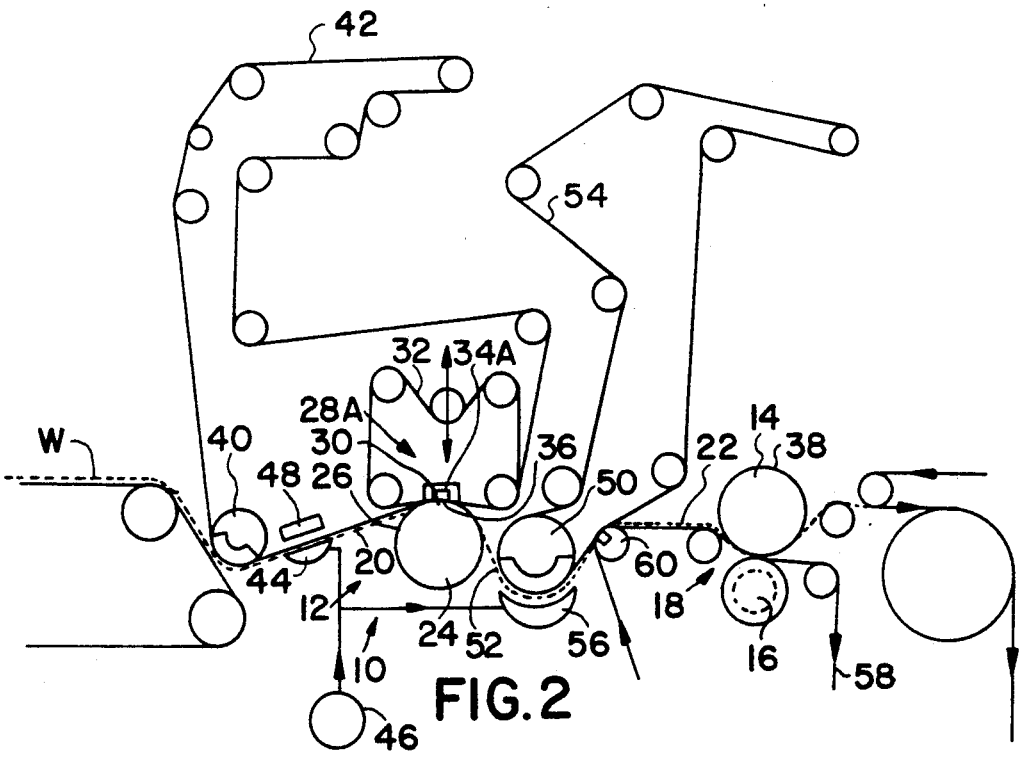
FIG. 2 is a view similar to that shown in FIG. 1 but showing a further embodiment of the present invention in which the extended nip press includes a hydrostatic shoe.

FIG. 2 is a side-elevational view of a further embodiment of the present invention in which the elongate pressing member 28A is a hydrostatic shoe 34A. In other respects, the embodiment shown in FIG. 2 is identical with the embodiment shown in FIG. 1.

FIG. 2 shows the press roll 14 defining a further smooth peripheral surface 38 such that the further smooth surface 38 comes into direct contact with the opposite side 22 of the web W relative to the one side 20 contacting the smooth surface 26 so that substantially uniform surface characteristics are imparted to both sides 20 and 22 of the web W.

The press apparatus 10 also includes a pick-up roll 40, such as a suction pick-up roll, which is disposed closely adjacent to the formed web W for picking up the web W.

A press felt 42 extends around the pick-up roll 40 such that the press felt 42 is disposed between the web W and the pick-up roll 40 so that the web W is transferred onto the press felt 42.

A steam box 44 is disposed closely adjacent to the press felt 42 and downstream relative to the pick-up roll 40. The steam box 44 is connected to a source of pressurized steam 46 such that the steam is applied directly to the web W supported by the press felt 42.

Vacuum means 48 are disposed closely adjacent to the steam box 44 such that the press felt 42 and the web W are disposed between the steam box 44 and the vacuum means 48. The press felt 42 is disposed between the web W and the vacuum means 48. The vacuum means 48 draws steam through the web W and the press felt 42.

The extended nip press 12 is disposed downstream relative to the vacuum means 48.

The bearing blanket 32 slidably cooperates with the pressing member 28 such that the press felt 42 and the web W are disposed between the bearing blanket 32 and the backing roll 24 during contiguous movement of the bearing blanket 32, the press felt 42 and the web W through the pressing section 30.

As shown in FIG. 1, the press apparatus 10 further includes a suction roll 50 which is disposed downstream relative to the pressing section 30 such that the web W is guided from the pressing section 30 in an open draw 52 to and around the suction roll 50.

A further felt 54 extends around the suction roll 50 such that the further felt 54 is disposed between the web W and the suction roll 50.

A further steam box 56 cooperates with the suction roll 50. The further steam box 56 is connected to the source of pressurized steam 46 such that the pressurized steam is applied directly to the pressed web W. Excess steam is drawn through the further felt 54 and through the suction roll 50.

A transfer felt 58 is disposed downstream relative to the suction roll 50 for transferring the web W from the further felt 54 to the transfer felt 58.

A suction guide roll 60 is disposed closely adjacent to the further felt 54. The transfer felt 58 extends around the suction guide roll 60 such that the web W is disposed between the further felt 54 and the transfer felt 58. The arrangement is such that when the suction guide roll 60 is connected to a source of partial vacuum, the web W transfers from the further felt 54 to the transfer felt 58.

The press roll 14 is disposed downstream relative to the suction guide roll 60.

Additionally, the roll 16 cooperating with the press roll 14 is a vented roll, such as a grooved, blind drilled or suction roll.

In operation of the press apparatus according to the present invention, the web is transferred by the pick-up roll from a forming wire and is disposed on the under side of the press felt 42. The web is subjected to steam which increases the amount of water removed during the subsequent extended nip pressing.

The steam-heated web extends through the pressing section and is guided in the open draw 52 away from the smooth surface of the backing roll 24. Thereafter, the web is again steam heated and transferred to the further felt where the opposite side 22 of the web comes into direct contact with the further smooth surface of the press roll 14 so that both sides of the web attain uniform surface characteristics.

The present invention provides a press apparatus that not only increases the amount of water removed from the web, but also enhances the symmetry of the resultant web.

What is claimed is:

1. A press apparatus for pressing a formed web of paper, said press apparatus comprising:

an extended nip press for pressing water from the formed web;

a press roll disposed downstream relative to said extended nip press;

a vented roll located below and cooperating with said press roll for defining therebetween a roll couple for further pressing the web such that substantially uniform surface characteristics are imparted to both sides of the web;

said extended nip press including: a backing roll defining a smooth peripheral surface, and said press apparatus being structured and arranged such that the web extends around said backing roll so that one side of the web is in direct contact with said smooth surface;

an elongate pressing member disposed above said backing roll and cooperating with said smooth surface for defining therebetween an extended pressing section for the passage therethrough of the web;

a bearing blanket slidably cooperating with said pressing member such that the web is disposed between said blanket and said backing roll during movement of said blanket and web through said pressing section;

a single felt disposed between said blanket and the web;

said backing roll being disposed beneath said elongate pressing member such that removal of broke is facilitated; and said press roll defining a further smooth peripheral surface and said press apparatus being structured and arranged so that said further smooth surface comes into direct surface contact with the opposite side of the web for imparting uniform surface characteristics to the web.

2. A press apparatus as set forth in claim 1 wherein said elongate pressing member is an elongate shoe defining a concave surface which cooperates with said smooth peripheral surface for defining therebetween said pressing section.

3. A press apparatus as set forth in claim 1 wherein said elongate pressing member is a hydrostatic shoe.

4. A press apparatus as set forth in claim 1 further including:

a pick-up roll disposed closely adjacent to the formed web for picking up the web;

a press felt extending around said pick-up roll such that said press felt is disposed between the web and said pick-up roll so that the web is transferred onto said press felt;

a steam box disposed closely adjacent to said press felt and downstream relative to said pick-up roll, said steam box being connected to a source of pressurized steam such that said steam is applied directly to the web supported by said press felt;

vacuum means disposed closely adjacent to said steam box such that said press felt and the web are disposed between said steam box and said vacuum means, said press felt being disposed between the web and said vacuum means, said vacuum means drawing said steam through the web and said press felt; and said extended nip press being disposed downstream relative to said vacuum means.

5. A press apparatus as set forth in claim 4 wherein said press felt is said single felt and said bearing blanket slidably cooperates with said pressing member such that said press felt and the web are disposed between said bearing blanket and said backing roll during contiguous movement of said bearing blanket, said press felt and the web through said pressing section.

6. A press apparatus for pressing a formed web of paper, said press apparatus comprising:

an extended nip press for pressing water from the formed web;

said extended nip press including:

a backing roll defining a smooth peripheral surface, and said press apparatus being structured and arranged such that the web extends around said backing roll so that one side of the web is in direct contact with said smooth surface;

an elongate pressing member disposed above said backing roll and cooperating with said smooth surface for defining therebetween an extended pressing section for the passage therethrough of the web;

a bearing blanket slidably cooperating with said pressing member such that the web is disposed between said blanket and said backing roll during movement of said blanket and web through said pressing section;

a single felt disposed between said blanket and the web;

a press roll disposed downstream relative to said extended nip press;

said press roll defining a further smooth peripheral surface and the press apparatus being structured and arranged such that said further smooth surface comes into direct contact with the opposite side of the web relative to said one side contacting said smooth surface so that substantially uniform surface characteristics are imparted to both sides of the web; a roll cooperating with said press roll for defining therebetween a roll couple for further pressing the web;

a pick-up roll disposed closely adjacent to the formed web for picking up the web;

a press felt extending around said pick-up roll such that said press felt is disposed between the web and said pick-up roll so that the web is transferred onto said press felt, wherein said press felt is said single felt;

a steam box disposed closely adjacent to said press felt and downstream relative to said pick-up roll, said steam box being connected to a source of pressurized steam such that said steam is applied directly to the web supported by said press felt;

vacuum means disposed closely adjacent to said steam box such that said press felt and the web are disposed between said steam box and said vacuum means, said press felt being disposed between the web and said vacuum means, said vacuum means drawing said steam through the web and said press felt;

said extended nip press being disposed downstream relative to said vacuum means;

said bearing blanket slidably cooperating with said pressing member such that said press felt and the web are disposed between said bearing blanket and said backing roll during contiguous movement of said bearing blanket, said press felt and the web through said pressing section;

a suction roll disposed downstream relative to said pressing section structured and arranged such that the web is guided from said pressing section in an open draw to and around said suction roll;

a further felt extending around said suction roll such that said further felt is disposed between the web and said suction roll;

a further steam box cooperating with said suction roll, said further steam box being connected to said source of pressurized steam such that pressurized steam is applied directly to the pressed web, excess team being drawn through said further felt and through said suction roll;

a transfer felt extending through said roll couple, said transfer felt being disposed downstream relative to said suction roll for transferring the web from said further felt to said transfer felt;

a suction guide roll disposed closely adjacent to said further felt, said transfer felt extending around said suction guide roll such that the web is disposed between said further felt and said transfer felt, the arrangement being such that when said suction guide roll is connected to a source of partial vacuum, the web transfers from said further felt to said transfer felt.

7. A press apparatus as set forth in claim 6 wherein said roll cooperating with said press roll is a vented roll.

8. A press apparatus for pressing a formed web of paper, said press apparatus comprising:

a pick-up roll disposed closely adjacent to the formed web for picking up the web;

a press felt extending around said pick-up roll such that said press felt is disposed between the web and said pick-up roll so that the web is transferred onto said press felt;

a steam box disposed closely adjacent to said press felt and downstream relative to said pick-up roll, said steam box being connected to a source of pressurized steam such that said steam is applied directly to the web supported by said press felt;

vacuum means disposed closely adjacent to said steam box, such that said press felt and the web are disposed between said steam box and said vacuum means, said press felt being disposed between the web and said vacuum means, said vacuum means draining said steam through the web to said press felt;

an extended nip press disposed downstream relative to said vacuum means for pressing water from the web;

said extended nip press including:

a backing roll defining a smooth peripheral surface such that the web extends around said backing roll in direct contact with said smooth surface;

an elongate pressing member disposed above said backing roll cooperating with said smooth surface for defining therebetween an extended pressing section for the passage therethrough of the web;

a bearing blanket slidably cooperating with said press member such that said press felt and the web are disposed between said bearing blanket and said backing roll during contiguous movement of said bearing blanket, said press felt and the web through said pressing section;

a suction roll disposed downstream relative to said pressing section such that the web is guided from said pressing section in an open draw to and around said suction roll;

a further felt extending around said suction roll such that said further felt is disposed between the web and said suction roll;

a further steam box cooperating with said suction roll, said further steam box being connected to said source of pressurized steam such that pressurized steam is applied directly to the pressed web, excess steam being drawn through said further felt and through said suction roll;

a transfer felt disposed downstream relative to said suction roll for transferring the web from said further felt to said transfer felt;

a suction guide roll disposed closely adjacent to said further felt, said transfer felt extending around said suction guide roll such that the web is disposed between said further felt and said transfer felt, the arrangement being such that when said suction guide roll is connected to a source of partial vacuum, the web transfers from said further felt to said transfer felt;

a press roll disposed downstream relative to said suction guide roll, said press roll defining a further smooth peripheral surface such that said further smooth surface comes into direct contact with the opposite side of the web coming into direct contact with said smooth surface; and a vented roll cooperating with said press roll for defining therebetween a roll couple such that said transfer felt extends through said roll couple, said roll couple further pressing the web such that substantially uniform surface characteristics are imparted to both sides of the web.

* * * * *

UNITED STATES PATENT AND TRADEMARK OFFICE

CERTIFICATE OF CORRECTION

PATENT NO. : 5,120,399

DATED : June 9, 1992

INVENTOR(S) : Scott E. Filzen

It is certified that error appears in the above—identified patent and that said Letters Patent is hereby corrected as shown below:

Column 3, Line 46: Please delete "1" and insert --10-- in place thereof.

Column 7, Line 41: Please delete "team" and insert --steam-- in place thereof.

Signed and Sealed this

Twenty-fourth Day of August, 1993

Bruce Lehman

*Attest:*

BRUCE LEHMAN

*Attesting Officer*

*Commissioner of Patents and Trademarks*